US007122737B2

(12) United States Patent
Hattori

(10) Patent No.: US 7,122,737 B2
(45) Date of Patent: Oct. 17, 2006

(54) SEMI-RIGID CABLE

(75) Inventor: Wataru Hattori, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 10/487,435

(22) PCT Filed: Aug. 21, 2002

(86) PCT No.: PCT/JP02/08401

§ 371 (c)(1),
(2), (4) Date: Jul. 8, 2004

(87) PCT Pub. No.: WO03/028040

PCT Pub. Date: Apr. 3, 2003

(65) Prior Publication Data

US 2004/0231882 A1 Nov. 25, 2004

(30) Foreign Application Priority Data

Aug. 22, 2001 (JP) ..... 2001-251798

(51) Int. Cl.
*H01B 7/00* (2006.01)

(52) U.S. Cl. ..... 174/28

(58) Field of Classification Search ..... 174/102 R, 174/106 R, 108, 109, 110 R, 113 R
See application file for complete search history.

(56) References Cited

U.S. PATENT DOCUMENTS 3,639,674 A * 2/1972 Stier ..... 174/36
3,973,227 A * 8/1976 Erculiani ..... 333/246
4,515,992 A * 5/1985 Gupta ..... 174/102 R
4,847,448 A * 7/1989 Sato ..... 174/103
4,970,352 A * 11/1990 Satoh ..... 174/106 R
5,574,260 A * 11/1996 Broomall et al. ..... 174/102 R
6,218,624 B1 * 4/2001 Hanssen et al. ..... 174/126.4
6,246,006 B1 * 6/2001 Hardin et al. ..... 174/106 R
6,307,156 B1 * 10/2001 Avellanet ..... 174/128.1
6,495,759 B1 * 12/2002 Yamamoto et al. ..... 174/106 R
2003/0024728 A1 * 2/2003 Yamamoto et al. ..... 174/113 R
2003/0168240 A1 * 9/2003 Ono et al. ..... 174/102 R

FOREIGN PATENT DOCUMENTS

EP 0 675 507 A2 10/1995
JP 62-295309 12/1987

(Continued)

OTHER PUBLICATIONS

Microfilm of the Specification and drawings annexed to the request of Japanese Utility Model Application No. 53144/1990 (Laid-open No. 12215/1992) (Nissei Denki Kabushiki Kaisha), Jan. 31, 1992, p. 4, line 8 to p. 5, line 11 (Family:none).

(Continued)

*Primary Examiner*—William H. Mayo, III
(74) *Attorney, Agent, or Firm*—Young & Thompson

(57) ABSTRACT

A semi-rigid cable coaxially includes a brass wire (1) having a silver-plated layer (2) formed by plating silver having a high conductivity, a dielectric body (3) prepared by using fluorocarbon resin, a polymer film (4) having a conductive film (inner layer of an outer conductor) (5) formed by deposition, and a metal pipe (6) having a low thermal conductivity as an outer layer of the outer conductor. The polymer film (4) is inserted into the metal pipe (6) with the conductive film (5) toward the outer circumference so that the conductive film (5) is electric contact with the metal pipe (6). The conductive film (5) has a thickness in a range not smaller than 1 micron and not greater than 10 microns.

12 Claims, 3 Drawing Sheets

FOREIGN PATENT DOCUMENTS

| | | |
|---|---|---|
| JP | 10-188688 | 7/1998 |
| JP | 11-224547 | 8/1999 |

OTHER PUBLICATIONS

Microfilm of the specification and drawings annexed to the request of Japanese Utlity Model Application No. 30315/1978 (Laid-open No. 133383/1979) (Simitomo Electric Industries, Ltd.), Sep. 14, 1979, claims (Family:none).

Microfilm of the specification and drawings annexed to the request of Japanese Utility Model Application No. 57678/1991 (Laid-open No. 127918/1992) (Junkosha Co., Ltd.) Nov. 20, 1992, (Family:none).

* cited by examiner

SEMI-RIGID CABLE

FIELD OF THE INVENTION

This invention relates to a semi-rigid cable (semi-rigid type coaxial cable), and particularly to a semi-rigid cable for connecting a high frequency device used at a low temperature to a machine used at a room temperature.

BACKGROUND OF THE INVENTION

Conventionally, a high temperature superconducting filter is used for communication of mobiles, communication of satellites, etc. In this case, the high temperature superconducting filter is used such that it is installed in the interior of a cooler to be cooled at a temperature of approximately 70K (Kelvin). And, the filter in the cooler is connected to a machine positioned on the outside of the cooler by the semi-rigid cable. Accordingly, it is necessary to suppress a heat inflow amount which is inflow from a room temperature to a cold stage (a low temperature portion by the cooler) through the semi-rigid cable, in order to lower a load of the cooler, or make it possible to use a cooler which is of a smaller type and a lower cooling capability, and lighter.

In case of making a long semi-rigid cable to be used to lower a heat inflow amount, or an outer diameter of it small, however, it is not preferable because transmission loss of an electromagnetic wave signal is increased. Further, in case of changing a material of a conductor, although a slight improvement is obtained, it is resulted that loss of an electromagnetic wave signal is increased, as a heat inflow amount is decreased, because a thermal conductivity of a metallic material is basically proportional to an electrical conductivity thereof in accordance with the law of Wiedemann-Franz.

Under such technical background, it is developed for a semi-rigid cable connecting between low and room temperature circumstances that an outer conductor (a conductor provided on an outer circumferential side of a coaxial cable) which is most related to heat inflow is fabricated by plating a thin film of a copper which is well in conductivity on an outside of a dielectric layer of fluoro-resin, as seen in products of Cryodevice Inc. According to this method, a thickness of copper which is an outer conductor is approximately 10 μm, so that it has a sufficient thickness not to invite the increase of loss, because a surface skin of, for instance, copper at 2 GHz (depth necessary for the transmission of signals) is approximately 1 μm. Further, a thickness of an outer conductor of an ordinary semi-rigid cable is more than 0.1 mm, so that a thickness of an outer conductor is made thin by approximately 10%, and a heat inflow amount coming trough the outer conductor is decreased by 10%.

Further, there is "a coaxial cable" disclosed in Japanese Patent Application laid-open No. 9-12904 as a prior application's invention example 1 similar in technical filed to the present invention. This has a double structure of an outer conductor comprising an outside outer conductor of bad thermal conductivity and an inside outer conductor of well electrical conductivity, so that electrical conductivity is ensured, and thermal transmission is suppressed from the outside of the cable to the inside thereof.

In the conventional semi-rigid cable, however, heat is easily transmitted from the exterior of a cold stage (a low temperature portion such as the interior of a cooler) to the interior thereof, because, for instance, copper which is a well conductor and well at thermal transmission is used for an outer conductor, and the outer conductor has a sufficient thickness to consider mechanical strength.

Further, there is a problem in reliability in a semi-rigid cable of Cryodevice Inc. in that a thin outer conductor is especially to be easily cracked or broken in bending process, so that a conductive plane is easily cut. Further, when a tough cable is used in consideration of mechanical strength and durable years, there occurs a problem in that costs increase in ensuring cooling force and an electric power bill for a cooler.

Further, as clearly described in section [0012] of the prior application's invention example 1, the outside outer conductor has no relation with signal transmission, and a purpose of the outside outer conductor is for the suppression of heat transmission into the inside outer conductor. That is, the purpose is for the suppression of the heat inflow toward the inside, so that it is not appropriate for a measure against a heat inflow flowing in the longitudinal direction of a cable or through a cross-section of a cable as intended by the present invention.

Explaining in more concretely, the outside outer conductor is desired to prevent heat from flowing to the inside outer conductor to be as thick as possible in accordance with the purpose of the prior application's invention example 1. For instance, when a stainless steel having a thickness of approximately 1 cm is used, it works largely as a non-thermal conductor to easily provide a temperature difference from several degrees to several tens degrees, although it deviates depending on balance of a heat inflow amount. In the invention, however, thermal shielding in the lengthwise of a cable, that is, a heat inflow through a cable cross-section is suppressed, the cable cross-section is preferable to be thin even at a portion of a non-thermal conductor. In a coaxial cable in the prior application's invention example 1, heat becomes difficult to be flowed from outside to inside, and mechanical strength is ensured, so that the outside outer conductor is preferable to be thick. That is, heat is made easier to be flowed in the longitudinal direction of a cable from the exterior of a cold stage to the interior thereof, and cost becomes high in a cooler. As described above, a semi-rigid cable according to the present invention is not along the object of the prior application's invention example 1, and the prior application's invention example 1 does not solve a problem of the present invention.

SUMMARY OF THE INVENTION

The present invention is made in view of these circumstances, and an object thereof is to provide a semi-rigid cable wherein, while transmission loss of signals is suppressed to be small, a heat inflow amount flowing through a cable cross-section, and a conductive plane is difficult to be cut, thereby realizing high reliability.

To realize such an object, the present invention has following features.

A semi-rigid cable according to the invention is characterized in that, in a semi-rigid cable having a double structure of an outer conductor comprising an inside outer conductor and an outside outer conductor, and comprising an inner conductor, a dielectric layer provided at an outer periphery of the inner conductor, and an outer conductor provided at an outer periphery of the dielectric layer coaxially arranged, the inside outer conductor is made of a well conductor having a thickness to suppress a heat inflow and is provided to be electrically in contact with the outside outer conductor made of a low thermal conductor; and a film sheet is provided between the inside outer conductor and the dielectric layer.

Further, A semi-rigid cable according to the invention is characterized in that, in a semi-rigid cable having a double structure of an outer conductor comprising an inside outer conductor and an outside outer conductor, and comprising an inner conductor, a dielectric layer provided at an outer periphery of the inner conductor, and an outer conductor provided at an outer periphery of the dielectric layer coaxially arranged, the inside outer conductor is of a high electrical conductive material, the outside outer conductor is of a material which is lower in thermal conductivity than the material of the inside outer conductor by one or two digits, and the outside outer conductor has a sufficiently decreased thickness to suppress a heat inflow in the longitudinal direction of the cable.

In the semi-rigid cable of the present invention, as understood by a series of technical means described above, the outer conductor is of the double structure, a high conductive material (well conductor) is used for the inside outer conductor, and a pipe made of a material which is lower in thermal conductivity than a well conductor such as copper etc. by one or two digits is used for the outside conductor. In this pipe, a polymer-resin film sheet having a vapor deposition layer of a well conductor on its outer surface for the inside outer conductor and the dielectric layer provided on the inside of the polymer-resin film sheet are inserted. This structure keeps reliability in accordance with mechanical strength provided by the pipe which is the outside outer conductor, the pipe having a relatively large cross-section area is low in thermal conductivity, the increase of loss does not occur with use of a well conductor for the inside outer conductor which is thin as a film on the polymer-resin film, and a cable cross-section is extremely small to keep low a thermal conductivity relative to heat flowing through the cable cross-section.

In the semi-rigid cable according to the present invention, a thickness of the inside outer conductor is preferable to be more than 1 μm and less than 10 μm. As described above, the thickness of the inside outer conductor is one to ten times of the surface skin depth, and is a sufficient thickness to suppress the deterioration of signal transmission loss, because a surface skin depth of copper at 2 GHz is approximately 1 μm. As described above, a thickness of an outer conductor is more than 0.1 mm in an ordinary coaxial cable, and it is approximately 10 μm in products of Cryodevice Inc., so that a thickness of the inside outer conductor is one several tenth to one several hundredth of an outer conductor of an ordinary semi-rigid cable, and it is a thickness of an extent that a high thermal conductivity is not exhibited.

BEST MODE FOR IMPLEMENTING THE INVENTION

Next, a semi-rigid cable according to the invention will be explained in detail.

Figure 1:
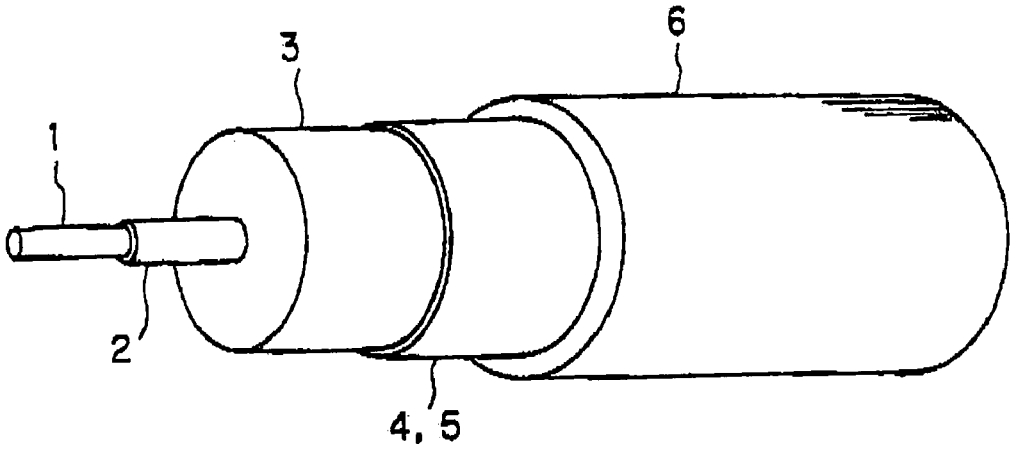
FIG. 1 is a perspective view showing a state in which each layer is successively cut in a semi-rigid cable in a first preferred embodiment of the present invention.
Figure 2:
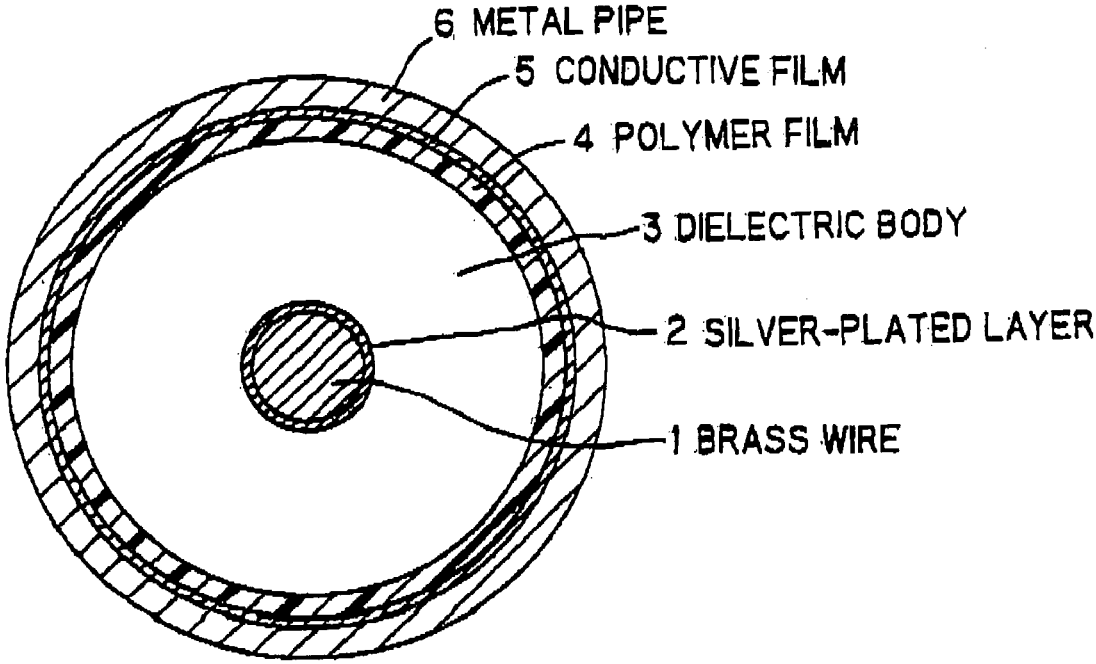
FIG. 2 is a view showing a cross-sectional structure of the semi-rigid cable in the first preferred embodiment of the present invention.

FIG. 1 is a perspective view showing a state in which each layer is successively cut in a semi-rigid cable in the first preferred embodiment of the present invention. FIG. 2 is a view showing a cross-sectional structure of the semi-rigid cable in the first preferred embodiment of the present invention. As shown in FIGS. 1 and 2, there are coaxially provided a brass-made wire 1, a silver-plating layer 2, a dielectric layer 3, a polymer-resin film 4, a well conductive film 5, and a metal pipe 6 successively on a central axis. That is, the brass-made wire 1 having the silver-plating layer 2 which is made of silver plating of high electrical conductivity, the dielectric layer 3 made of fluoro-resin, the polymer-resin film 4 deposited with a well conductive film (inside outer conductor) 5 by the vapor deposition method, and the metal pipe 6 of a low thermal conductivity which is an outside outer conductor are provided. Now, FIG. 1 shows a state in which the polymer-resin film 4, and the well conductive film 5 vapor-deposited on the polymer-resin film 4 are cut as one layer.

Here, the polymer-resin film 4 is provided on the outer periphery of the dielectric layer 3, such that one surface deposited with the well conductive film 5 is positioned in the direction of the outer periphery, and the well conductive film 5 is in contact with an inner wall of the metal pipe 6 to keep the well electrical contact along the overall of the cable.

The well conductive film 5 may be any material, if the material has high electrical conductivity, and one material selected from Cu, Al, Ag and Au is preferable. A material having such high electrical conductivity is selected for the well conductive film 5, polyimide film or polyester film is selected for the polymer-resin film 4, and the vapor deposition method is selected for the deposition of the well conductive film 5 on the polymer-resin film 4, so that a film sheet to be deposited with the well conductive film 5 having a conductor thickness of approximately 5 μm may be one sold in the market. That is, it becomes possible to actively use an elementary material available at a low cost in a range of thickness from 1 μm to 10 μm in which it is sufficiently thicker than the above described surface skin, and the heat inflow does not become large. Further, the well conductive film 5 is of a structure of the vapor deposition on the polymer-resin film 4, so that the well conductive film 5 is deposited thereon without damaging the polymer-resin film 4, the conductive plane is more difficult to be cut than the well conductive film 5 deposited directly on the dielectric layer 3, and a cable of high reliability is provided with low cost.

The above described film available in the market which is deposited with the well conductive film 5 having a conductor thickness of approximately 5 μm is generally one in which Al or Cu is vapor-deposited on the polymer-resin film 4, however, it is not limited to this, any film sheet may be used, and a material available at a low cost may be used, if a material of the well conductive film 5 vapor-deposited thereon has high electrical property.

Further, in case of using, for instance, a stainless pipe having a thickness of 0.1 mm as the metal pipe 6, thermal transmission caused by this pipe is suppressed to the same extent as a case where a copper pipe having a thickness of 1 μm is used. Like this, a material of a low thermal conductivity, preferably, at least one material selected from CuNi, stainless alloy, brass, and BeCu is used for the metal pipe 6 of the outside outer conductor, so that a heat inflow amount through the cable cross-section is largely lowered. That is, a material which is lower in thermal conductivity than a well conductor such as copper etc. is used for the outside outer conductor, so that heat inflow is suppressed to be compatible with a copper pipe having a thickness of several microns to several tens microns in regard to heat inflow through the outside outer conductor having a thickness of several hundreds microns. Although strength is extremely low to result in the difficulty in manufacturing and handling, if a copper pipe having such a thickness is manufactured, a stainless pipe having a thickness of 0.1 mm is selected for the above described metal pipe 6, so that strength is extremely high, handling is easy, and it is available in the market at a low cost.

The dielectric layer 3 is generally of fluoro-resin, however, it is not limited to this, and another material may be used.

The silver-plating layer 2 is formed by plating silver on an outer surface of the brass wire 1. Like this, when an inner conductor is of a double structure comprising the silver-plating layer 2 having high electrical conductivity and the brass wire 1 having low thermal conductivity, a constant effect is expected to suppress a heat inflow amount through a cross-section in the same manner as a case where the outer conductor is of a double structure, as compared to a case where a well conductive wire is manufactured to be positioned on the central axis. However, because the inner conductor is smaller in area to occupy the cable cross-section than the double structure of the outer conductor, the smaller effect is expected.

As structured above, the semi-rigid cable according to the present invention, cracks in the inside outer conductor (well conductive film 5) are extremely narrow, even if the cracks may occur in bending process, etc. so that electrical conduction is ensured via the outside outer conductor (metal pipe 6) which is electrically conducted. Thus, electrical conduction is ensured, so that high reliability is ensured, even if cracks may occur in adopting bending process by a machine. Further, even in a case where electrical conduction is ensured via the outside outer conductor for a portion of cracks, loss is almost negligible via the outside outer conductor, because a width of the cracks is narrow. That is, even in a case where electrical conduction is ensured via the metal pipe 6 of a low thermal conductivity, loss of signal transmission is minute not to be a problem with use of the metal pipe 6, because a distance through which a signal is transmitted via a low electrical conductivity portion of the metal pipe 6 is extremely short. In this manner, reliability of the semi-rigid cable is remarkably enhanced without giving any affect on signal transmission.

Next, a semi-rigid cable in the second preferred embodiment according to the invention will be explained.

Figure 3:
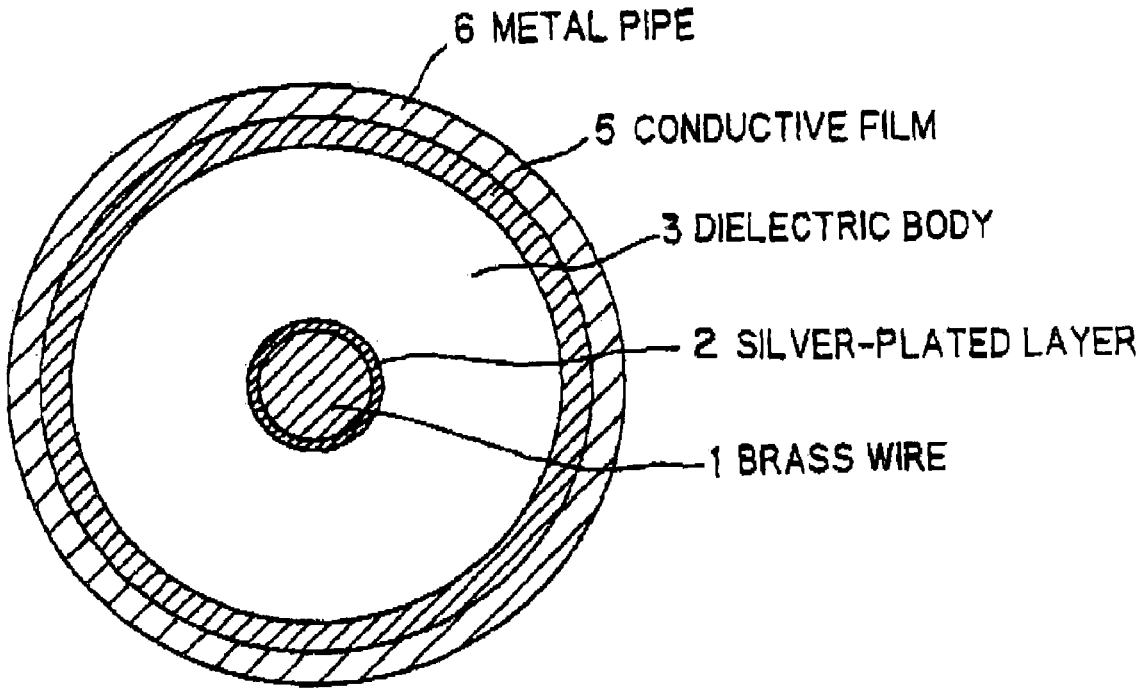
FIG. 3 is a view showing a cross sectional structure of a semi-rigid cable in a second preferred embodiment of the present invention.
Figure 4:
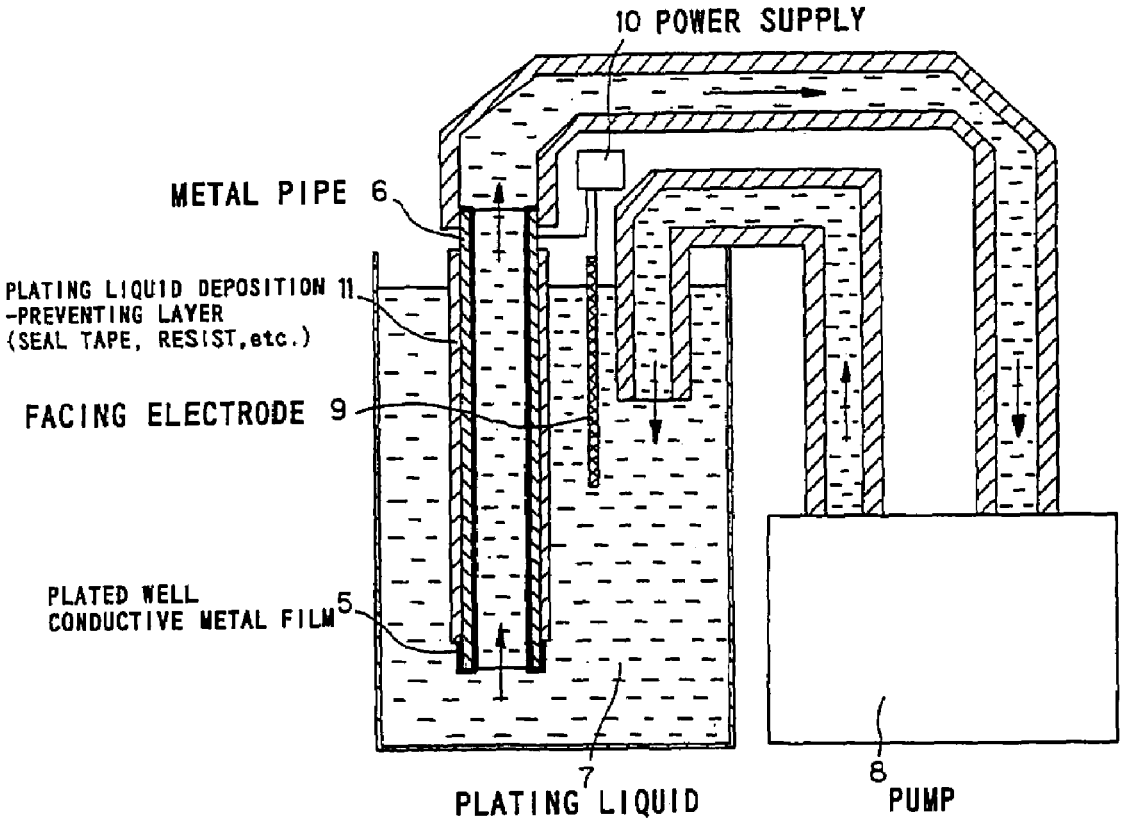
FIG. 4 is an explanatory view showing an apparatus used in manufacturing an inside outer conductor (metal film) 5 in the semi-rigid cable in FIG. 3.

FIG. 3 is a view showing a cross-sectional structure of a semi-rigid cable in the second rigid cable according to the invention, and FIG. 4 is an explanatory view showing an apparatus to be used for manufacturing the inside outer conductor (metal film) 5 in the semi-rigid cable in FIG. 3.

The semi-rigid cable in the second preferred embodiment is different from the semi-rigid cable (FIG. 2) in the first preferred embodiment in that the polymer-resin film 4 is omitted, and the well conductive film (inside outer conductor) 5 is formed by plating. Because other structural elements are similar to those of the semi-rigid cable in the first preferred embodiment, the explanation of those structural elements is omitted.

In the second preferred embodiment, a metal pipe 6 (outside outer conductor) of a low thermal conductivity is plated on its inner surface with well conductive film (inside outer conductor) 5. Therefore, because the polymer-resin film 4 in the first preferred embodiment is unnecessary in the present preferred embodiment, this is not provided (see FIG. 3). The well conductive film 5 and the metal pipe 6 are structured in material and thickness in the same manner as those explained in the first preferred embodiment.

A method of forming the well conductive film (inside outer conductor) 5 by plating will be explained as follows. As shown in FIG. 4, a metal pipe 6 (outside outer conductor) of a low thermal conductivity is immersed in plating liquid 7 including metal ions which is a material of the film 5, and current is flowed between a facing electrode 8 and the metal pipe 6 from a power supply 10, while the plating liquid 7 is circulated by a pump 8. At this time, the surface of the metal pipe 6 is covered at a portion of not forming the film 5 with a plating liquid deposition-preventing layer 11. On the outer surface of the metal pipe 6, a portion which is not covered with the plating liquid deposition-preventing layer 11 (see FIG. 4) is provided to facilitate soldering at a time of joining a connector to the portion. The plated well conductive metal film 5 is formed on the surface of the metal pipe 6 (surface in contact with plating liquid 7) which is not covered with the plating liquid deposition-preventing layer 11. In this method, the outside outer conductor is made of a pipe to allow the circulation of the plating liquid 7 through the inside of the pipe 6 with use of the pump 8, so that the ununiformity of the plated metal film 5 is prevented to provide the metal film 5 having a uniform thickness. Conventionally, a plating method of circulating plating liquid through the interior of a narrow pipe was not known. Further, a concentration of the plating liquid 7 is decreased in the interior of the pipe 6, as plating is progressed in the conventional plating method, so that the plated metal film 5 is often uneven in thickness.

In this manner, the well conductive film 5 (inside outer conductor) is formed on the inner surface of the metal pipe 6 which is the outer conductor.

Even in the semi-rigid cable in the present preferred embodiment, the same effect as that obtained in the semi-rigid cable in the first preferred embodiment is obtained.

Now, the above described preferred embodiments are preferred embodiments of the present invention, and it is apparent that they may be changed in the scope without departing from the technical thought of the present invention.

INDUSTRIAL APPLICABILITY

As apparent from the above explanation, there are provided, in the semi-rigid cable according to the present invention, an inside outer conductor of a polymer-resin film deposited with a well electrical conductive film of more than 1 μm and less than 10 μm, and an outside outer conductor of a low thermal conductive metal pipe, both of which are electrically in contact, so that a heat inflow amount flowing through a cable cross-section is less in addition to less signal transmission loss, and load on a cooler which maintains a low temperature portion is less in addition to low cost.

Further, the polymer-resin film deposited with the well electrical conductive film which is the inside outer conductor is provided in such a manner that the well electrical conductive film is electrically in contact with the low thermal conductive metal pipe which is the outside outer conductor, so that signal transmission loss is not increased with low cost, and high reliability for signal communication is ensured.

What is claimed is:

1. A semi-rigid cable comprising:

an inner conductor;

a dielectric layer provided at an outer periphery of the inner conductor; and an outer conductor provided at an outer periphery of the dielectric layer, the outer conductor and dielectric layer being coaxially arranged;

wherein the outer conductor comprises an inside outer conductor and an outside outer conductor, said outside outer conductor having an exterior surface that is the outermost and exposed surface of the cable; and wherein the inside outer conductor is of a material having high electrical conductivity, the outside outer conductor is a metal pipe with a thermal conductivity lower than that of the material of the inside outer conductor by one to two digits, and a thickness of the outside outer cable is decreased to a thickness sufficiently to suppress a heat inflow in the longitudinal direction of the cable.

2. The semi-rigid cable as defined in claim 1, further comprising a film sheet between the inside outer conductor and the dielectric layer.

3. The semi-rigid cable as defined in claim 2, wherein:

the inside outer conductor is vapor-deposited on one surface of the film sheet.

4. The semi-rigid cable as defined in claim 2, wherein:

the film sheet is a polymer-resin film sheet.

5. The semi-rigid cable as defined in claim 1, wherein:

the inside outer conductor has a thickness of more than 1 μm and less than 10 μm.

6. The semirigid cable as defined in claim 1, wherein:

the inside outer conductor is of at least one material selected from copper, aluminum, silver, and gold.

7. The semi-rigid cable as defined in claim 1, wherein:

the metal pipe of at least one material selected from CuNi, stainless alloy, brass and BeCu.

8. The semirigid cable as defined in claim 1, wherein:

the material of the outside outer conductor is stainless alloy.

9. The semi-rigid cable as defined in claim 1, wherein:

the inside outer conductor is plated on an inner surface of the outside outer conductor.

10. A method of manufacturing a semi-rigid cable outer conductor used for a semi-rigid cable having an inner conductor, the method comprising the steps of:

providing a dielectric layer at an outer periphery of the inner conductor;

providing an outer conductor at an outer periphery of the dielectric layer, the outer conductor and dielectric layer being coaxially arranged;

immersing at least an inner surface of the outer conductor into plating liquid; and circulating the plating liquid in the longitudinal direction of the outer conductor while flowing current through the outer conductor as an electrode of one side, thereby providing the outer conductor with a double structure in which an inside outer conductor is plated on an inner surface of the outer conductor, wherein the outer conductor is a metal pipe having an outer surface that is the outermost and exposed surface of the cable.

11. An electronic machine having a built-in device, to be used at a low temperature, which is connected with the semi-rigid cable as defined in claim 2.

12. An electronic machine having a built-in device, to be used at a low temperature, which is connected with the semi-rigid cable as defined in claim 1.

* * * * *